United States Patent [19]

Shigeta

[11] Patent Number: 4,687,436

[45] Date of Patent: Aug. 18, 1987

[54] GASIFIED FUEL COMBUSTION APPARATUS

[76] Inventor: Tadao Shigeta, 840-1, Ushizuma, Shizuoka-Shi, Shizuoka-Ken, Japan

[21] Appl. No.: 893,570

[22] Filed: Aug. 5, 1986

[51] Int. Cl.[4] ..... F23C 5/32

[52] U.S. Cl. ..... 431/173; 431/352; 110/264

[58] Field of Search ..... 431/158, 173, 352; 110/264; 60/748, 738, 752

[56] References Cited

U.S. PATENT DOCUMENTS

| | | | |
|---|---|---|---|
| 1,618,808 | 2/1927 | Burg | 431/173 |
| 1,831,466 | 11/1931 | Schmidt | 110/264 |
| 2,664,702 | 1/1954 | Lloyd et al. | 60/752 |
| 2,777,407 | 1/1957 | Schindler | 431/173 |
| 4,054,409 | 10/1977 | Ando et al. | 431/173 |

*Primary Examiner*—Carroll B. Dority, Jr.

*Attorney, Agent, or Firm*—Koda and Androlia

[57] ABSTRACT

A gasified fuel combustion apparatus is constructed such that an air chamber connected with a blower is provided to surround a cylindrical combustion chamber having an outer wall made of a heat-resistant material. A fuel supplying tube is provided to open tangentially in a closed end portion of the combustion chamber and a plurality of main air blowing holes of a comparatively large diameter are provided through the outer wall of the combustion chamber at positions adjacent to the fuel supplying tube such that the main air blowing holes are inclined to both of the rotating direction of the fuel and the blowing direction of the combustion flame. A number of auxiliary air blowing holes having a comparatively small diameter are also provided through the outer wall of the combustion chamber at positions downstream from the main blowing holes with orientations similar to those of the main air blowing holes.

5 Claims, 5 Drawing Figures

GASIFIED FUEL COMBUSTION APPARATUS

BACKGROUND OF THE INVENTION

This invention relates to a gasified fuel combustion apparatus wherein gasified fuel obtained from, for instance, a distilling device can be burned perfectly.

Heretofore, a gasified fuel combustion apparatus combined with a distilling device has been proposed by Japanese Patent Laid-Open No. 59-231307. This conventional apparatus comprises a cylindrical chamber provided upward of a rectangular distilling chamber, the internal surface of which is lined by a heat-resistant material such as caster. Surrounding the cylindrical chamber is provided an air supply chamber which is connected to an air supplying blower. A plurality of holes are provided through the circumferential wall of the cylindrical chamber so that the holes dispose obliquely upwardly and guide the air supplied from the air supply chamber into the cylindrical chamber in a manner flowing upward along a helical path.

In the above described conventional apparatus, a gasified fuel produced in the distilling chamber is introduced into the lower end of the cylindrical chamber and forced upward by the aid of the helical flow of air in the cylindrical chamber. Thus the gasified fuel moving along a circumferential path in the cylindrical chamber is sufficiently mixed with air helically flowing upward, thereby attaining a perfect combustion of the gasified fuel. However, the fuel moving upward along a radially inward path in the cylindrical chamber is not sufficiently mixed with air, thus giving rise to an imperfect combustion, emitting black smoke and reducing the amount of heat thereby produced. When the mixing ratio is not improved, any attempt to merely increase the amount of air increases the content of oxygen in the exhaust gas and thereby reduces the thermal efficiency of the combustion apparatus.

SUMMARY OF THE INVENTION

The object of this invention is to provide a gasified fuel combustion apparatus wherein fuel and air are both moved in a helical manner in a cylindrical chamber, so that the fuel and air are mixed together sufficiently and perfect combustion of fuel is realized by a least amount of air.

This and other objects are achieved according to this invention by a gasified fuel combustion apparatus comprising a cylindrical combustion chamber having an outer wall made of a heat-resistant material, an air chamber provided to surround the combustion chamber, a blower supplying air to the air chamber, a fuel supply tube opening into a closed end of the cylindrical combustion chamber in a tangential manner so as to rotate a gasified fuel supplied therethrough in one direction, a plurality of main air blowing holes having large diameters, each forming through the outer wall of the cylindrical combustion chamber at a position adjacent to the fuel supplying tube with an orientation inclined to both of the rotating direction of the fuel and the blowing direction of a combustion flame, and a number of auxiliary air blowing holes having comparatively small diameters provided through the outer wall of the combustion chamber at positions downstream from the main blowing holes with orientations similar to those of the main blowing holes.

In the combustion apparatus, the gasified fuel is supplied into the combustion chamber through the fuel supply tube opening into the chamber in a tangential manner, so that the fuel thus supplied is rotated helically around the central axis of the cylindrical combustion chamber while it flows to an exhaust port of the combustion chamber. The fuel thus rotated helically is brought into contact with air which is blown into the combustion chamber through the main blowing holes and the auxiliary blowing holes with orientations oblique to both of the rotating direction of the fuel and blowing direction of the combustion flame, and the combustion efficiency and hence the thermal efficiency of the combustion apparatus can be substantially improved.

DESCRIPTION OF THE PREFERRED EMBODIMENT

Figure 1:
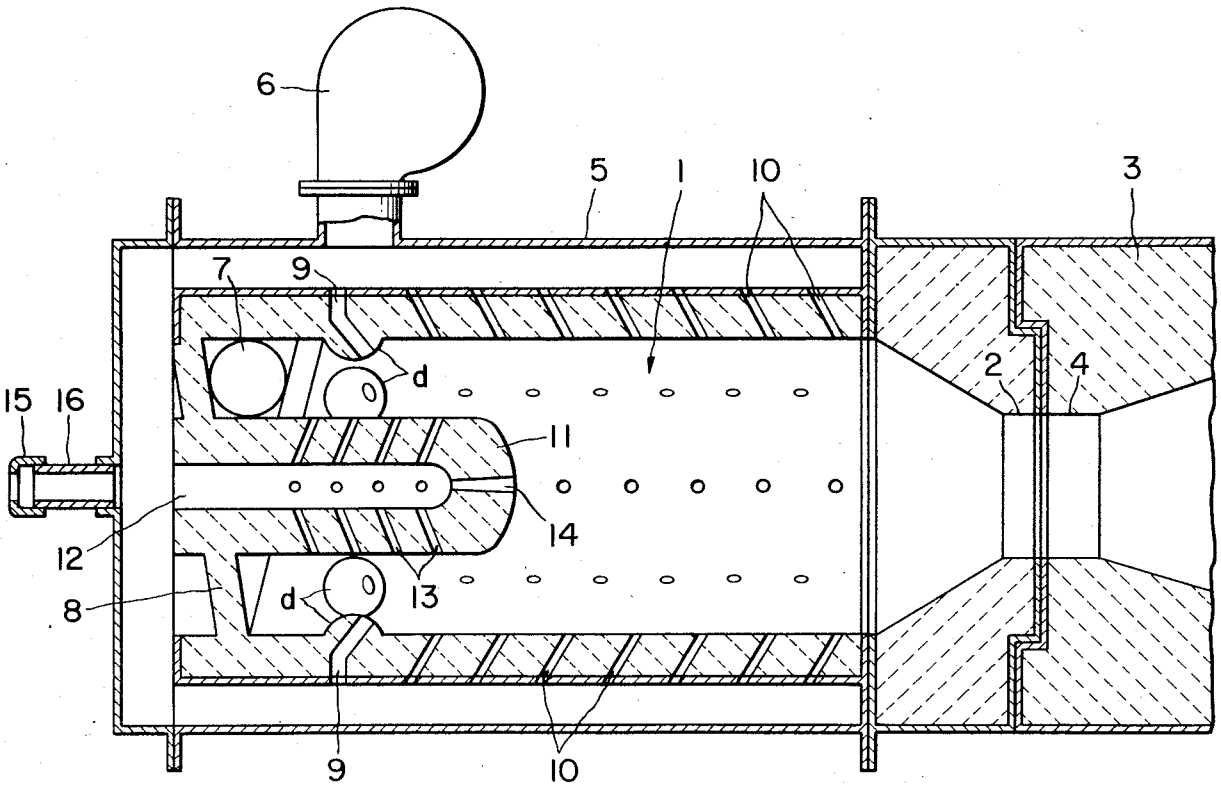
FIG. 1 is a longitudinal sectional view of a gasified fuel combustion apparatus constituting a preferred embodiment of this invention.
Figure 2:
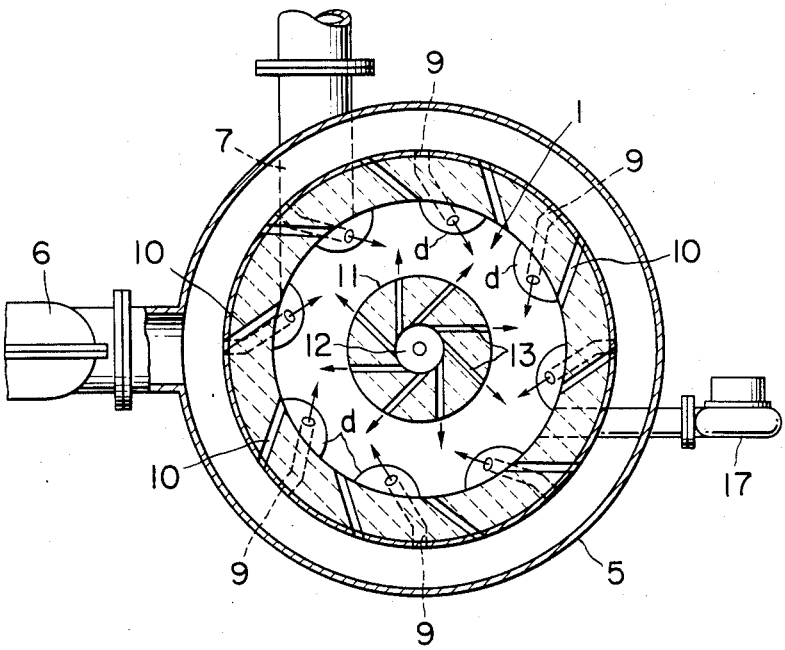
FIG. 2 is a cross-sectional view of the embodiment shown in FIG. 1.

The invention will now be described hereunder in detail with reference to FIGS. 1 through 5. In FIGS. 1 and 2, there is illustrated a gasified fuel combustion apparatus according to this invention which comprises a cylindrical combustion chamber 1 lined with a heat-resistant material such as caster. One end of the combustion chamber 1 is closed while the other opening end thereof is formed into an exhaust port 2 of the combustion flame, having an inner diameter smaller than that of the main portion of the combustion chamber 1. The exhaust port 2 is connected to an inlet port 4 of a heat exchanger 3.

An air chamber 5 is provided to surround the outside of the combustion chamber 1 in a concentric manner. A blower 6 is provided at an appropriate position of the wall surface of the air chamber 5 for supplying air into the air chamber 5. The air supplied into the air chamber 5 is blown out into the combustion chamber 1 through a plurality of blowing holes which are described hereinlater in more detail. A gasified fuel supply pipe 7 is connected to the closed end of the chamber 1, so that the pipe 7 opens into the chamber 1 in a tangential manner, and the fuel supplied through the pipe 7 flows along a helical path in the combustion chamber 1. The helical flow of the fuel is further enhanced by a helical groove 8 formed along one part of the internal surface of the chamber 1.

Through the circumferential wall of the combustion chabmer 1 are provided a plurality of main air blowing holes 9 at positions adjacent to the fuel supply pipe 7 with a predetermined spacing provided therebetween.

Figure 3:
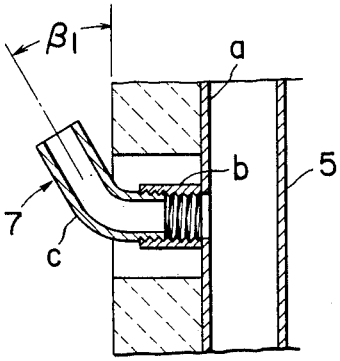
FIGS. 3 and 4 are diagrams showing the construction of a main air blowing hole in detail.
Figure 4:
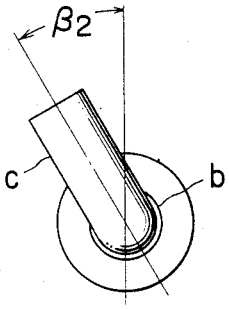
Figure 5:
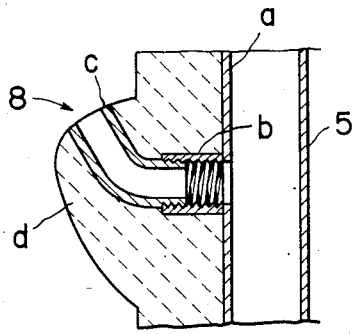
FIG. 5 is a diagram showing the complete construction of the main air blowing hole.

Each of the main air blowing holes 9 is constructed as follows with reference to FIGS. 3 through 5. A short pipe b of 25 mm in diameter is fixed to an outer wall plate a of the combustion chamber 1 as shown in FIG. 3, and an elbow c of an obtuse angle and having an outer diameter substantially equal to the inner diameter of the short pipe b is connected in screw-engagement with the short pipe b. The elbow c is disposed such that a part of the elbow c extending toward the interior of the chamber 1 forms an angle $\beta_1$ relative to the surface of the chamber 1 as shown in FIG. 3, while it forms another angle $\beta_2$ relative to the longitudinal axis of the combustion chamber 1 as shown in FIG. 4. With this construction, the air introduced in the chamber 1 through the main blowing holes 9 is rotated in a direction equal to that of the helical flow of the gasified fuel. The angle $\beta_2$ may be adjusted according to the kind and amount of the fuel to be burned in the chamber 1, such that the fuel rotates a required number of turns before it reaches the delivery port 2 of the chamber 1. Then the pipe b and the elbow c are covered in a stream-lined manner by a material such as caster as shown at d in FIG. 5.

In addition, a plurality of auxiliary air blowing holes 10 are provided through the circumferential wall of the combustion chamber 1 on the downstream side of the main air blowing holes 9. The auxiliary holes 10 are also disposed oblique in two directions as in the case of the main air blowing holes 9 and the diameter thereof is selected approximately 8 mm. The auxiliary holes 10 are arranged at a predetermined pitch.

Internally of the closed end of the fuel combustion chamber 1 is provided a hollow rectifying cylinder 11 having an internal space 12 communicating with the air chamber 5. Another group of auxiliary blowing holes 13 are provided through the circumferential wall of the rectifying cylinder 11 so as to be disposed obliquely in two directions as in the case of the auxiliary blowing holes 10. The holes 13 permit to supply air from inside of the fuel flow, improve mixing ratio between air and fuel, and enhance helical movement of the gasified fuel. An inspection hole 14 is further provided at the top of the rectifying cylinder 11 for inspecting combustion condition in the combustion chamber 1. The inspection hole 14 also serves to blow out air therethrough. An inspection window made of a tubular member 16 and a cover 15 is provided through the closing end wall of the cylindrical combustion chamber 1 at a position axially aligning with the inspection hole 14 formed through the rectifying cylinder 11. The cover 15 is removed out of the tubular member 16 when the combustion condition within the combustion chamber 1 is observed through the inspection window.

An ignition burner 17 is provided outside of the combustion chamber 1 for igniting the gasified fuel at the time of the initiation of the operation of the combustion apparatus.

According to the construction and the operations of this invention described hereinbefore, the following advantages and features are obtained or attained.

Since air is supplied through entire circumference of the combustion chamber and the gasified fuel is supplied in the air in the form of a helical flow, the mixing ratio between fuel and air can be substantially improved, and a perfect combustion can be achieved regardless of a comparatively small amount of air.

Since air blowing holes are disposed obliquely to the rotating direction of the fuel and the blowing direction of the combustion flame, helical movement of the gasified fuel can be enhanced by the air blown through the air blowing holes, and flowing state and flowing velocity of the fuel can be stabilized so as to stabilize the combustion of the fuel.

Since several blowing holes of a comparatively large diameter are provided through the circumferential wall of the combustion chamber at positions adjacent to the fuel supplying tube and a large number of air blowing holes of a comparatively small diameter are provided on the downstream side of the first mentioned blowing holes so as to constantly supply a required amount of oxygen, the amount of remaining oxygen in the exhaust gas can be restricted to several % and the thermal efficiency of the combustion apparatus can be substantially improved.

In addition, the air supplying chamber is provided around the combustion chamber, so that air can be preheated to a high temperature, and since the combustion chamber is held in a red-heat condition, the combustion therein can be performed satisfactorily without fear of fire hazard.

What is claimed is:

1. A gasified fuel combustion apparatus comprising:

a cylindrical combustion chamber having an outer wall made of a heat-resistant material;

an air chamber provided to surround said combustion chamber;

a blower located on a wall of said air chamber so as to supply air to said air chamber;

a fuel supplying tube opening into a closed end of said cylindrical combustion chamber in a tangential manner so as to rotate a gasified fuel supplied therethrough in one direction;

a plurality of main air blowing holes having diameters, each formed through the outer wall of said cylindrical combustion chamber at a position adjacent to said fuel supplying tube with an orientation inclined to both of the rotating direction of the fuel and the blowing direction of a combustion flame; and a number of auxiliary air blowing holes having diameters, each smaller than that of said main air blowing hole, provided through the outer wall of said combustion chamber at positions downstream from said main blowing holes with orientations similar to those of said main air blowing holes.

2. The gasified fuel combustion apparatus according to claim 1 wherein a rectifying cylinder of a hollow construction is further provided in the closed end of said fuel combustion chamber, an internal space of said rectifying cylinder is communicated with said air chamber, and a plurality of additional air blowing holes similar to said auxiliary air blowing holes are provided through said rectifying cylinder for supplying air therethrough.

3. The gasified fuel combustion apparatus according to claim 1 wherein each of said main air blowing holes is formed by a short pipe secured to said outer wall of said cylindrical combustion chamber and an elbow of an obtuse angle connected with said short pipe in a screw-thread engagement.

4. The gasified fuel combustion apparatus according to claim 1 wherein means are further provided through said closed end of said cylindrical combustion chamber for permitting inspection of the condition of the combustion caused in said cylindrical combustion chamber.

5. The gasified fuel combustion apparatus according to claim 1 wherein ignition means are further provided outside of said cylindrical combustion chamber for initiating operation of said combustion apparatus.

* * * * *